US006984299B2

(12) United States Patent
Han et al.

(10) Patent No.: US 6,984,299 B2
(45) Date of Patent: Jan. 10, 2006

(54) METHODS FOR DETERMINING ORGANIC COMPONENT CONCENTRATIONS IN AN ELECTROLYTIC SOLUTION

(75) Inventors: Jianwen Han, Danbury, CT (US); Mackenzie E. King, Southbury, CT (US)

(73) Assignee: Advanced Technology Material, Inc., Danbury, CT (US)

( * ) Notice: Subject to any disclaimer, the term of this patent is extended or adjusted under 35 U.S.C. 154(b) by 0 days.

(21) Appl. No.: 10/833,194

(22) Filed: Apr. 27, 2004

(65) Prior Publication Data

US 2005/0236274 A1 Oct. 27, 2005

(51) Int. Cl.
*C25D 21/14* (2006.01)

(52) U.S. Cl. ..... 205/81; 205/83; 205/101; 205/296; 205/787

(58) Field of Classification Search ..... 205/81, 205/82, 84, 101, 296, 787
See application file for complete search history.

(56) References Cited

U.S. PATENT DOCUMENTS 4,707,378 A * 11/1987 McBride et al. ..... 427/8
4,812,210 A * 3/1989 Bonivert et al. ..... 205/787
6,572,753 B2 * 6/2003 Chalyt et al. ..... 205/81

OTHER PUBLICATIONS

Keith B. Oldham and Jan C. Myland "Fundamentals of Electrochemical Science" Academic Press, San Diego, 1994, p. 329-330.
Allen J. Bard, "Electrochemical Methods, Fundamentals and Applications" 2nd edition, John Wiley & Son, New York, 2001, p. 15.
Yonghui Liu "Testing Technology of Electrochemistry", Beijing, 1987, p. 159 (English relevance attached).
Alexander Milchev and Irene Montenegro, J. Electroanal. Chem., 333 (1992), pp. 93-102.

* cited by examiner

*Primary Examiner*—Roy King
*Assistant Examiner*—William T. Leader
(74) *Attorney, Agent, or Firm*—Yongzhi Yang; Margaret Chappuis; Tristan A. Fuierer

(57) ABSTRACT

The present invention relates to a method and apparatus for determining organic additive concentrations in a sample electrolytic solution, preferably a copper electroplating solution, by measuring the double layer capacitance of a measuring electrode in such sample solution. Specifically, the present invention utilizes the correlation between double layer capacitance and the organic additive concentration for concentration mapping, based on the double layer capacitance measured for the sample electrolytic solution.

7 Claims, 1 Drawing Sheet

METHODS FOR DETERMINING ORGANIC COMPONENT CONCENTRATIONS IN AN ELECTROLYTIC SOLUTION

BACKGROUND OF THE INVENTION

1. Field of the Invention

The present invention relates to methods and apparatuses for determining organic component concentrations in an electrolytic solution, and more specifically to determination of organic component concentrations in a copper electroplating solution.

2. Description of the Related Art

In electrochemical deposition (ECD) process, the rigorous control of the relative proportions of respective inorganic and organic ingredients in the ECD bath is critical to the achievement of satisfactory results in the rate of metal film formation and the quality of the film so formed. During the use of the plating bath solution, the plating process may be affected by depletion of inorganic components and organic additives as well as by organic byproduct formation. The ECD bath chemistry therefore must be maintained by periodic replacement of a part or the entire ECD bath. It is therefore important to continuously or periodically monitor the concentrations of inorganic and/or organic components in the ECD bath, and responsively add respective components to the bath to maintain the composition of the bath in an effective state for the electrochemical deposition operation.

It is therefore one object of the present invention to provide an improved method for measuring concentrations of one or more organic components in an ECD bath.

Other objects and advantages will be more fully apparent from the ensuring disclosure and appended claims.

SUMMARY OF THE INVENTION

The present invention in one aspect relates to a method for determining concentration of an organic component in a sample electrolytic solution. Such method comprises the steps of:

(a) applying a potential step to the sample electrolytic solution by using at least a working electrode and a reference electrode;

(b) measuring double layer capacitance of the working electrode in the sample electrolytic solution under the applied potential step; and (c) determining the concentration of the organic component in the sample electrolytic solution, based on the double layer capacitance measured in step (b).

Another aspect of the present invention relates to an apparatus for measuring concentration of an organic component in a sample electrolytic solution, comprising:

(a) a measuring chamber containing a working electrode and a reference electrode, for receiving at least a portion of the sample electrolytic solution;

(b) an electrical source for applying a potential step to the sample electrolytic solution through the working and reference electrodes;

(c) means for measuring double layer capacitance of the working electrode in said sample electrolytic solution under the applied potential step; and (d) computational means for determining the concentration of the organic component in said sample electrolytic solution, based on the double layer capacitance measured for the working electrode in the sample electrolytic solution.

Other aspects, features and embodiments of the present invention will be more fully apparent from the ensuing disclosure and appended claims.

DETAILED DESCRIPTION OF THE INVENTION, AND PREFERRED EMBODIMENTS THEREOF

Figure 1:
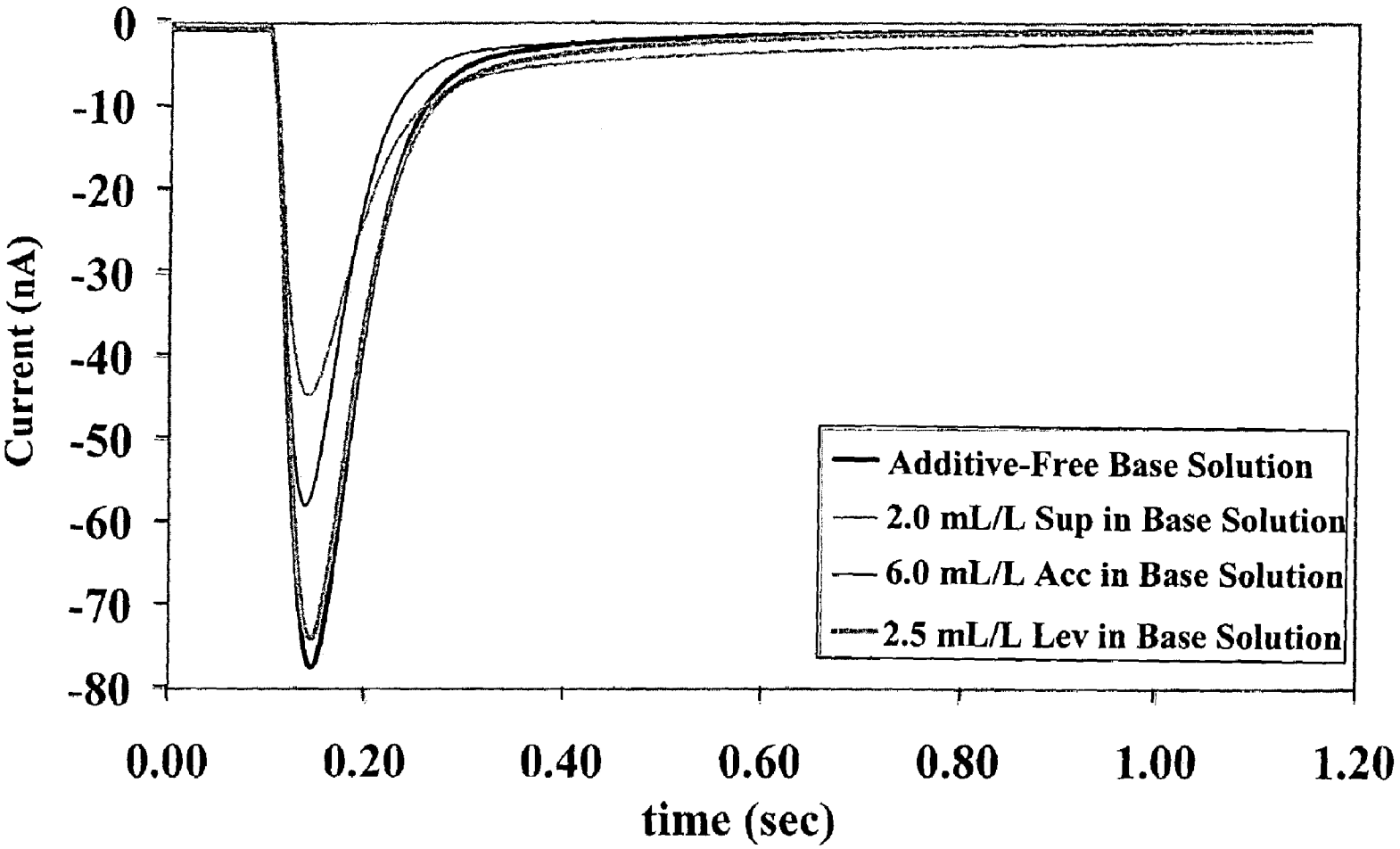
FIG. 1 shows the current response curves measured for four different electrolytic solutions over time under an initial potential step of about −0.208 V.

The boundary between a measuring electrode and an electrolytic solution is called an interface. The electrolytic solution is a first phase in which charge is carried by the movement of ions, and the measuring electrode is a second phase in which charge is carried by the movements of electrons.

Two types of processes occur at the electrode-solution interface: (1) the faradaic process involves actual electron transfers between the measuring electrode and the electrolytic solution; and (2) the non-faradaic process involves adsorption and desorption of organic species onto and from the electrode surface where no charge actually cross the interface.

During non-faradaic process, although no charge actually cross the interface, external transient currents are present when the electrical potential, electrode surface area, or the composition of the electrolytic solution changes. These transient currents flow to charge or discharge the electrode-solution interfacial region, which is generally referred to as an electrical double layer.

The capacitance of such electrical double layer ($C_d$) is a function of the applied electrical potential (E), the composition and concentration of the electrolytic solution, and the active electrode surface area. When the applied electrical potential and the active electrode surface area are constant, the double layer capacitance is directly correlative to the composition and concentration of the electrolytic solution.

Therefore, the present invention in one aspect provides a method for measuring the organic additive (i.e., suppressors, accelerators, and levelers) concentrations in a metal electroplating solution, more preferably a copper electroplating solution, based on the double layer capacitance of a working electrode that is immersed in such metal electroplating solution.

Under a given initial electrical potential or potential step (E), the metal electroplating solution demonstrates a current response that is characterized by an initial current peak or maximum current ($I_{max}$) at initial time $t_0$ and an exponentially decaying current (I) at subsequent time t, which are determined by:

$$I_{\max} = \frac{E}{R_s}; \tag{I}$$

$$I = I_{\max} \times e^{\left(-\frac{t}{R_s C_d}\right)} \tag{II}$$

where $R_s$ is the electrical resistance of the electrolytic solution, and e is the base for natural exponential.

When $t=R_sC_d$, the current I has decreased to about 37% of the initial current peak, as follows:

$$I=I_{max}\times e^{(-1)}=0.368\times I_{max} \quad \text{(III)}$$

The value of $R_sC_d$ is usually referred to as the time constant $t_c$, which is characteristic to the given electrode-solution interface.

From equations (I)–(III), one can express the double layer capacitance $C_d$ as:

$$C_d = \frac{t_c \times I_{\max}}{E} \quad \text{(IV)}$$

Therefore, by measuring the current peak $I_{max}$, the time constant $t_c$ required for the current to decrease to about 37% of the current peak $I_{max}$, and the initial potential step E, the double layer capacitance $C_d$ of the measuring electrode in the sample electroplating solution can be determined quantitatively.

The current response of an electrolytic solution can be monitored by using one or more measuring devices. For example, an ammeter can be used to directly measuring the current flow through the sample electrolytic solution over time; alternatively, a combination of one or more potentiometers and one or more ohmmeters can be used to measuring the real-time potential and electrical resistance of the sample electrolytic solution, from which the current flow can be calculated.

Preferably, one or more calibration solutions are provided for constructing a correlative data set, which empirically correlates the double layer capacitance with the concentration of an organic component of interest. Specifically, each calibration solution so provided is compositionally identical to the sample electroplating solution but for the concentration of the organic component of interest, and each calibration solution preferably contains said organic component of interest at a unique, known concentration. The double layer capacitance of each calibration solution is measured according to the method described hereinabove and used in conjunction with the respective known concentration of the organic component of interest in each calibration solution to form the correlative data set.

Such correlative data set can then be used for direct mapping of the concentration of the organic component of interest in the sample electroplating solution, based on the double layer capacitance measured for such sample electroplating solution.

Preferably, the present invention employs a computer-based quantitative analyzer, which may comprise a computer, central processor unit (CPU), microprocessor, integrated circuitry, operated and arranged to collect the current response data for determining the double layer capacitance of the sample solution and according to the method described hereinabove and for mapping the organic component concentration. More preferably, such quantitative analyzer has a correlative data set stored in its memory for direct concentration mapping based on the double layer capacitance measured for the sample solution. Alternatively, such quantitative analyzer comprises a capacitance-concentration correlation protocol for in situ construction of such a correlative data set based on current response data collected for various calibration solutions and the respective known organic component concentrations in such calibration solutions. The capacitance-concentration correlation protocol can be embodied in any suitable form, such as software operable in a general-purpose programmable digital computer. Alternatively, the protocol may be hard-wired in circuitry of a microelectronic computational module, embodied as firmware, or available on-line as an operational applet at an Internet site for concentration analysis.

Usage of double layer capacitance for determining organic component concentrations in the present invention is particularly advantageous for analysis of copper electroplating solutions. First, measurement of the double layer capacitance involves little or no reduction of the copper ions ($Cu^{2+}$), because such measurement is carried out in a potential range that is lower than that required for $Cu^{2+}$ reduction reaction, which protects the measuring electrode from being alloyed with the reduced copper and increases the useful life of the electrode. Further, since measurement of the double layer capacitance does not involve copper deposition, the organic additives contained in the sample electrolytic solution are not consumed, and the concentration of such organic additives in the electrolyte solution throughout the measurement cycles remains constant, therefore significantly increasing the reproducibility of the measurement results.

FIG. 1 shows the current response curves of four different electrolytic solutions, which include (1) a first electrolytic solution that contains cupper sulfate, sulfuric acid, and chloride and is additive-free, (2) a second electrolytic solution that is compositionally identical to the first electrolytic solution but for containing a suppressor at a concentration of about 2.0 mL/L; (3) a third electrolytic solution that is compositionally identical to the first electrolytic solution but for containing an accelerator at a concentration of about 6.0 mL/L; (4) a fourth electrolytic solution that is compositionally identical to the first electrolytic solution but for containing a leveler at a concentration of about 2.5 mL/L.

An initial potential step (E) of about −0.208 V is applied to each of the above-listed electrolytic solutions, and the current response curves of the electrolytic solutions under such initial potential step are obtained.

The current peak ($I_{max}$) and the time constant ($t_c$) required for the current (I) to drop from the peak value to about 37% of the peak value can be directly read from such current response curves, and from which the double layer capacitance ($C_d$) can be calculated, according to equation (IV) provided hereinabove.

Following is a table listing the measurements obtained from the current response curves shown in FIG. 1.

| | Solution (1) | Solution (2) | Solution (3) | Solution (4) |
|---|---|---|---|---|
| Potential Step (E) | −0.208 V | −0.208 V | −0.208 V | −0.208 V |
| Current Peak ($I_{max}$) | | | | |
| Ave. | −77.6 nA | −45.1 nA | −58.1 nA | −73.8 nA |
| RSD | −0.20% | −1.50% | −0.50% | −0.50% |
| Time Constant ($t_c$) | 0.065 sec. | 0.0749 sec. | 0.0586 sec. | 0.0684 sec. |
| Double Layer Capacitance ($C_d$) | 24.2 nF | 16.2 nF | 16.4 nF | 24.3 nF |
| Capacitance Change Rate | 0% | −33% | −32% | 0.04% |

Among the three organic additives tested, the suppressor as added into solution (2) has the greatest impact on the double layer capacitance, and the leveler as added into solution (4) has the least impact at the given concentration.

Therefore, different organic additives have relatively different impact on the double layer capacitance, which can be used for distinguishing said organic components from one another.

While the invention has been described herein with reference to specific aspects, features and embodiments, it will be recognized that the invention is not thus limited, but rather extends to and encompasses other variations, modifications and alternative embodiments. Accordingly, the invention is intended to be broadly interpreted and construed to encompass all such other variations, modifications, and alternative embodiments, as being within the scope and spirit of the invention as hereinafter claimed.

What is claimed is:

1. A method for determining concentration of an organic component in a sample electrolytic solution, said method comprising the steps of:

(a) applying a potential step to the sample electrolytic solution by using at least a working electrode and a reference electrode;

(b) measuring double layer capacitance of the working electrode in said sample electrolytic solution under the applied potential step;

(c) determining the concentration of the organic component in said sample electrolytic solution, based on the double layer capacitance measured in step (b), and (d) adding organic component when the concentration of organic component falls below effective electrolytic solution levels, wherein the sample electrolytic solution comprises a copper electroplating solution comprising copper ions, and wherein the copper ions do not deposit onto the working electrode.

2. The method of claim 1, wherein the organic component comprises an organic additive selected from the group consisting of suppressors, accelerators, and levelers.

3. The method of claim 1, wherein one or more calibration solutions containing said organic component at unique, known concentrations are provided, wherein the double layer capacitance of the working electrode in each of said calibration solutions under the potential step is measured, which is correlated to the concentration of the organic component in respective calibration solution, and wherein the concentration of the organic component in the sample electrolytic solution is determined based on the double layer capacitance measured for said sample electrolytic solution and the capacitance-concentration correlation obtained by measuring the calibration solutions.

4. The method of claim 3, wherein said one or more calibration solutions are compositionally identical to said sample electrolytic solution but for the organic component concentration.

5. The method of claim 1, wherein the double layer capacitance of the working electrode is measured by monitoring current response of the sample electrolytic solution under the potential step over time.

6. The method of claim 5, wherein the double layer capacitance ($C_d$) of the working electrode is determined by:

$$C_d = \frac{t_c \times I_{\max}}{E}$$

wherein E is the applied potential step, $I_{max}$ is the current peak observed under said applied potential step E, and $t_c$ is a time constant, which is equal to the time required for the current to drop from $I_{max}$ to about $0368 \times I_{max}$.

7. The method of claim 1, further comprising identifying the organic component in the sample electrolytic solution by comparing double layer capacitance of the working electrode in a sample electrolytic solution devoid of organic component relative to double layer capacitance of the working electrode in a sample electrolytic solution having organic component therein.

* * * * *